United States Patent [19]

Fagan et al.

[11] Patent Number: 4,535,937

[45] Date of Patent: Aug. 20, 1985

[54] GRADED ACTUATION OF HYDRAULICALLY ACTUATED POOL CLEANING HEADS

[76] Inventors: Joseph H. Fagan, 1312 N. Barkley, Mesa, Ariz. 85203; Paul J. Pristo, 9046 N. 123rd St., Scottsdale, Ariz. 85259

[21] Appl. No.: 486,731

[22] Filed: Apr. 20, 1983

[51] Int. Cl.[3] ..... B05B 3/06

[52] U.S. Cl. ..... 239/206; 239/66; 239/204; 239/489

[58] Field of Search ..... 239/204–206, 239/251, 253, 489, 66, 69; 137/624.13, 624.18; 285/208–210, 302

[56] References Cited

U.S. PATENT DOCUMENTS

| | | | |
|---|---|---|---|
| 1,893,210 | 1/1933 | Rider | 239/489 |
| 3,247,969 | 4/1966 | Miller | 210/169 |
| 3,414,298 | 12/1968 | Butler | 285/209 |
| 3,449,772 | 6/1969 | Werner | 4/172 |
| 3,472,265 | 10/1969 | Davis | 239/66 X |
| 3,521,304 | 7/1970 | Ghiz | 4/172.16 |
| 3,794,061 | 2/1974 | Horvath et al. | 137/624.18 X |
| 4,133,560 | 1/1979 | Ishikawa et al. | 285/209 X |
| 4,188,673 | 2/1980 | Carter | 239/251 X |
| 4,202,499 | 5/1980 | Mathews | 239/206 |
| 4,212,088 | 7/1980 | Goettl et al. | 239/204 X |
| 4,271,541 | 6/1981 | Mathews | 4/490 |
| 4,347,979 | 9/1982 | Mathews | 239/206 |
| 4,371,994 | 2/1983 | Mathews | 4/490 |
| 4,391,005 | 7/1983 | Goettl | 239/204 X |

*Primary Examiner*—Jeffrey V. Nase
*Assistant Examiner*—Daniel R. Edelbrock
*Attorney, Agent, or Firm*—James F. Duffy

[57] ABSTRACT

A hydraulically actuated device is employed as part of a pool cleaning system. An improved structure assembly of a hydraulically actuated core within a housing provides ease of manufacture and assembly. Graded control of the application of pressure and the flow of fluid through the system is provided so that the hydraulic device is actuated in a relatively gradual and graded manner to overcome the deleterious effects of abrupt actuation of such devices and the resultant water hammer, pressure surges which are generated in such abruptly operated systems. Improved jet orifices enclosed within the hydraulically actuated cylinder of the device provide for more efficient disturbance of sediments on the interior surfaces of the pool in the immediate vicinities of the hydraulically actuated devices. Graded control of fluid flow and the sequential actuating of selected hydraulically controlled devices is provided in a manner which ensures that a constant rate of fluid flow through the system is maintained at all times.

16 Claims, 16 Drawing Figures

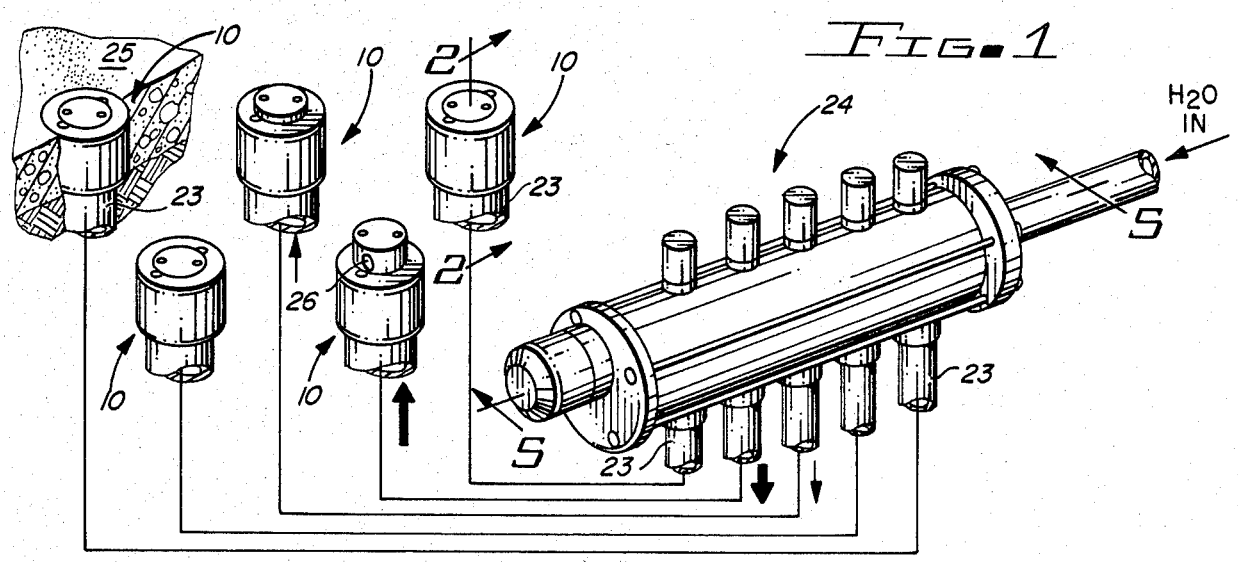
FIG. 1
25
10
23
26
2
24
$H_2O$ IN
S
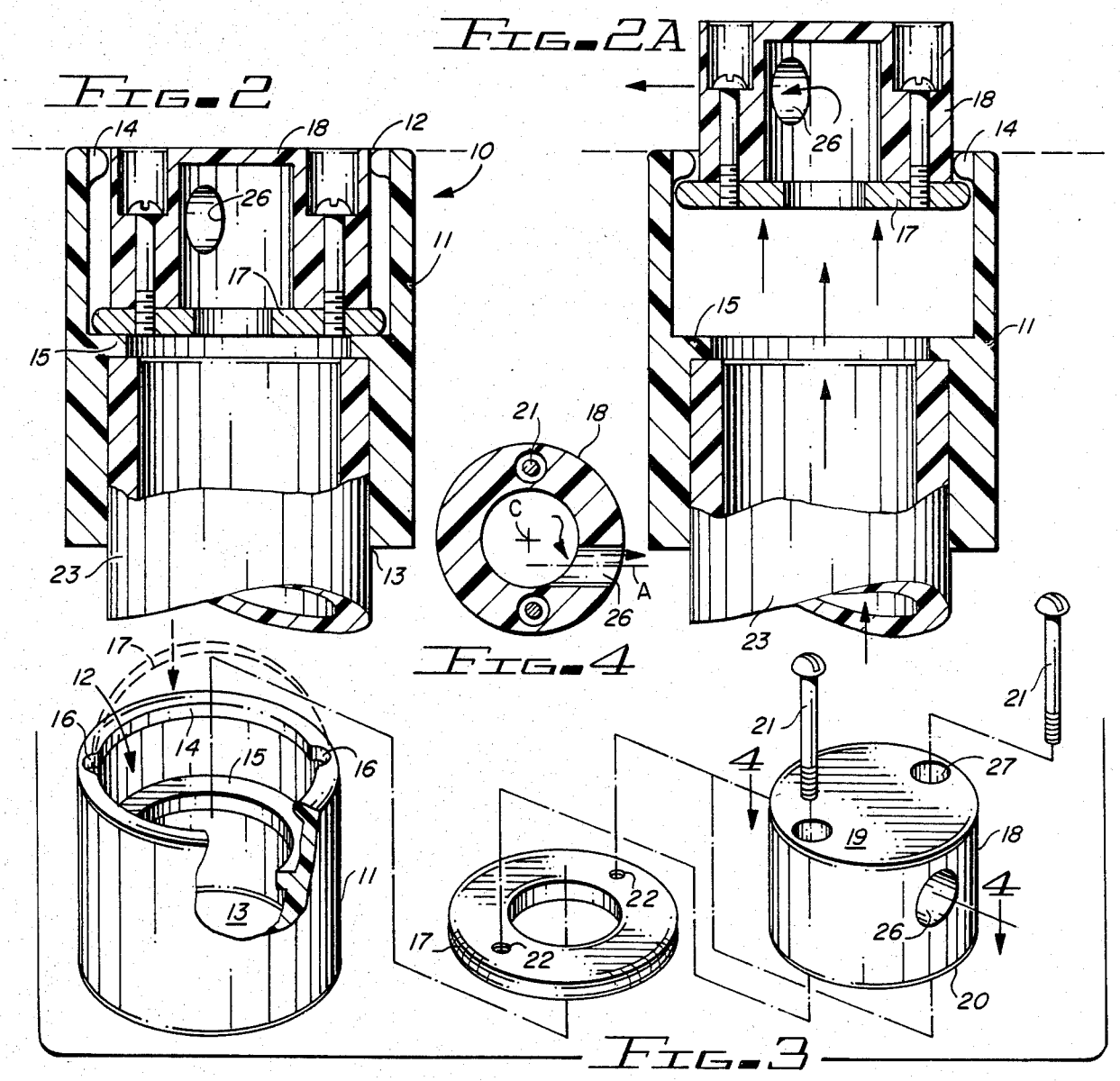
FIG. 2
FIG. 2A
FIG. 4
FIG. 3
10
11
12
13
14
15
16
17
18
19
20
21
22
23
26
27
A
C
4

GRADED ACTUATION OF HYDRAULICALLY ACTUATED POOL CLEANING HEADS

BACKGROUND

1. Field of the Invention

The invention relates to the field of pool cleaning systems.

The invention particularly relates to pool cleaning systems wherein pop-up water actuated jet cleaning devices are mounted flush with the interior surface of the swimming pool.

The invention specifically relates to the field of pool cleaning apparatus wherein the actuation of pop-up jets is a graded, non-abrupt actuation and the fluid flow rate through the pool cleaning system is maintained constant to prevent water hammer pressure surges which can be deleterious to the system.

2. Prior Art

In-pool cleaning systems are well known in the prior art. Miller, in U.S. Pat. No. 3,247,969, and Werner, in U.S. Pat. No. 3,449,772, provide water jet heads which are permanently emplaced a slight distance above the interior surface of a pool. Werner also introduces a flush mounted pop-up jet head which offers no obstruction to a pool user when the cleaning system is in operation.

Others also have disclosed pop-up rotating jet heads which are embedded nominally flush with the interior surface of the pool. Such disclosures will be found in Ghiz, U.S. Pat. No. 3,521,304; in Mathews U.S. Pat. Nos. 4,202,499 and 4,271,541, as well as 4,347,979, and 4,371,994. Another rotary pop-up jet is disclosed by Gould in U.S. Pat. No. 4,322,860. All of these latter noted pop-up rotary jet heads are characterized by the complexity of the mechanism required for establishing the rotation of the jet heads.

Two recent and surprisingly similar U.S. patents disclose pop-up jet heads of significantly reduced complexity when compared with the prior art. These are the patents to Carter, U.S. Pat. No. 4,188,673 and that to Goettl et al, U.S. Pat. No. 4,212,088. Yet as uncomplex a device as these latter pop-up heads present, they still present an assemblage of items which are subject to failure under the constant, abrupt, battering by the pop-up head with the interfering stop elements of the housings.

It is therefore an objective of the invention to provide a hydraulically actuated pop-up cylinder of less complex design than that of the prior art.

It is a further objective of the invention to provide a system in which hydraulically actuated cores are reciprocated outward from a housing by a graded, non-abrupt application of fluid pressure to the device.

It is another objective of the invention to provide an in-floor pool cleaning system having gradedly, non-abruptly actuated pop-up heads with improved jet stream means, the effect of the improved jet stream means being more efficient movement into suspension of matter in close proximity to the jet head as well as reducing the leakage of pressurized water from potential voids which may exist between the housing and the pop-up head when the jet is in operation.

A further objective of the invention is the provision of means for maintaining a constant rate of flow of fluid through the system so that, unlike prior art systems, there are no water hammer, pressure surges in the system, which water surges not only frequently lead to failure of the pop-up head assemblies but to plumbing and equipment failures at other points throughout the pool cleaning, filtering and water circulation systems.

SUMMARY OF THE INVENTION

In a first presently preferred embodiment, the invention comprises a hydraulically actuated core which is captively ejectable from its housing upon application of a hydraulic force. This embodiment comprises a cylindrical housing means having open ends. Rather than being an assembly of parts, the housing is a single element component. The housing is provided with a first diameter-reducing shoulder adjacent to a first open end of the housing and a second, similar diameter-reducing shoulder is located at a selected position between the open ends of the housing. The first diameter-reducing shoulder is interrupted by diametrically opposed egress means.

An annular weight is insertable within the cylindrical housing via these egress means. It is thereafter positionable within the housing such that the transverse axis of the annular weight is orthogonal to the longitudinal axis of the housing. When so positioned, the annular weight is reciprocal within the housing within the limits defined by the first and second diameter-reducing shoulders.

A cylindrical core is insertable within the housing and is reciprocal within the space defined by the first diameter-reducing shoulder. The cylindrical core is coupled to the annular weight after emplacement of both within the housing and both the core and the weight are then reciprocal within the housing within the limits established by the interfering relationships of the first and second diameter-reducing shoulders with the annular weight.

Fluid transmission means are employed for communicating fluid under pressure to the remaining open end of the housing. To non-abruptly exercise the cylindrical core within the housing and within the limits established by the first and second shoulders therein, means for gradedly governing the fluid pressure provided by a source of pressurized fluid to the fluid transmission means is provided.

When a plurality of these devices is employed, the means for gradedly governing the application of fluid pressure to the housings and their reciprocating cores further comprises means for sequentially, gradedly governing fluid pressure to each of a plurality of transmission means so as to sequentially, non-abruptly exercise selected ones of the cylindrical cores.

Each of the cylindrical cores is provided with a jet means for ejecting the pressurized fluid employed in actuating the core. Water is ejected from the jet means into the surrounding area when selected ones of the cores are exercised to protrude beyond the first open end of their respective cylindrical housings. With the jet off-set from the longitudinal axis of rotation of the cores, a coupling moment is created to rotate each cylindrical core about its axis of rotation as the core is exercised between the limits established by the first and second diameter-reducing shoulders.

When the devices are emplaced in the interior surface of a water bearing container, such as a swimming pool, the pressurized water ejected from the jet agitates the water sufficiently to place matter which has settled to the interior surface of the container into suspension within the body of water contained. By directing the jet downward toward the interior surface of the container, improved agitation of the water within the vicinity of the device is improved and enhancement in the interfering force exerted between the first diameter-reducing shoulder and the annular weight is achieved to reduce leakage of pressurized water in this area.

The means for sequentially, gradedly governing the fluid flow to non-abruptly exercise selected ones of these cylindrical cores comprises a plurality of sequentially actuated fluid valve means each of which communicates with one of the plurality of transmission means. In turn, each of said valve means further comprises means for gradedly controlling the flow of pressurized fluid sequentially through each of said valves so as to gradedly exercise sequentially selected ones of the cylindrical cores. Also provided is means for maintaining a constant flow rate of the fluid into and out of the means for sequentially, gradedly governing the fluid pressure for non-abruptly exercising the selected core. This means for maintaining a constant flow rate of fluid comprises means for maintaining a fluid flow through at least a selected two of the plurality of fluid valves as these valves are sequentially actuated. By maintaining at least two of these valves at all times in a state in which fluid is flowing, a constant fluid flow rate is maintained even though each of the plurality of valves is sequentially actuated to its full fluid flow condition as well as being sequentially actuated to its fluid cut-off position. The maintenance of this constant fluid flow obviates water hammer pressure surges in the system and increases the useful lifetime of the system as well as of the component parts thereof.

Such a constant fluid flow is achieved by use of a plurality of cam valve actuating means coupled to a cam shaft wherein the cams are emplaced on the cam shaft for selectable sequential, graded actuation of the fluid valves such that at least two such valves will always be selectedly, gradedly actuated to communicate fluid to selected ones of the hydraulically actuated cores.

For distributing and gradedly controlling the fluid flow to the system, fluid distribution apparatus is employed. This apparatus comprises a fluid reservoir having an input connected to the source of pressurized fluid and a plurality of outputs for the egress of pressurized fluid from the reservoir. A selected one of each of a plurality of fluid valves is coupled to a selected one of the reservoir outputs to gradedly control the egress flow of fluid to such output. Individual valve actuating means selectedly coupled to each of the fluid valves sequentially and gradedly actuates each said valve and maintains a constant fluid flow rate through the reservoir.

As earlier noted, a cam shaft and individual cam valve actuators coupled to the shaft are employed to actuate selected ones of the plurality of fluid valves in a graded, non-abrupt manner such that at least a selected two of the fluid valves is being so gradedly actuated at all times to maintain a constant fluid flow rate through the reservior. Ball valves have proven efficient and the cams may be staggered along the cam shaft to provide a sequential graded actuation of each said ball valve between full-open and full-closed conditions of the ball valves in a manner to maintain a sum-total egress fluid flow rate through at least a sequentially selected graded actuated two of these ball valves which egress fluid flow rate is eqivalent to the ingress fluid flow rate into the reservoir.

The invention may be described in a specific embodiment of a swimming pool cleaning system for maintaining matter introduced into the water of the pool in suspension whereby the removal of such suspended matter from the pool water is facilitated as the water is circulated through the filtering system associated with the pool. Such filtering systems have means for circulating water under pressure to and from the pool through the filtering system. The swimming pool cleaning system comprises an assembly of elements which in turn comprise a cylindrical housing embedded in the interior of the swimming pool. The housing has first and second open ends with the first open end communicating with the interior of the swimming pool and the second open end beneath the interior surface of the swimming pool and communicating with a source of pressurized circulating pool water. As before, the housing is also provided with a first diameter-reducing shoulder adjacent to the first open end and a second diameter-reducing shoulder at a selected position between the first and second open ends. Weighting means are provided which are insertable within the cylindrical housing and positionable thereafter for reciprocal motion within the housing between limits defined by an interfering relationship between the weight and the first and second shoulders. Again, a cylindrical core is insertable within the first open end of the housing and is coupled to the weight for reciprocation with the weight within the housing.

Means are provided for gradedly governing the flow of water to the second open end of the housing from a source of pressurized circulating pool water so as to non-abruptly reciprocate the cylindrical core within the housing.

Jet means are coupled to the cylindrical core to eject a jet of water downwardly toward the interior surface of the swimming pool when the cylindrical core is reciprocated outwardly from the housing in response to a graded increase of water flow from the source of the pressurized circulating pool water being communicated to said housing.

By supporting the jet means off-set from the longitudinal axis of rotation of the core, a coupling moment is again created to rotate the core within the housing as the core is reciprocatingly exercised within the housing by the graded governing of the flow of water to the housing. A plurality of such assembly of elements may be located in spaced apart relationship in the interior of the swimming pool, the graded governing of the flow of water provided by means which sequentially and gradedly govern water flow to sequentially selected ones of the housings. For this purpose, a water distribution assembly is emplaced between the source of pressurized circulating pool water and said housings.

A plurality of gradedly actuatable fluid flow valves comprises part of the water distribution assembly.

To prevent water hammer pressure surges, the water distribution assembly also comprises means to maintain a constant water flow rate through the distribution assembly. The distribution assembly itself further comprises a water reservoir having an input connected to the source of pressurized circulating pool water and a plurality of outputs for the egress of pressurized water from the reservoir to selected ones of said housings. Means are provided so that a selected one of the plurality of gradedly actuatable fluid flow valves is coupled to a selected one of the plurality of outputs of the reservoir. Means are, of course, provided for sequentially and gradedly actuating selected ones of the plurality of fluid flow valves. This latter means comprises a cam shaft with a plurality of cam valve actuators coupled thereto to cammingly sequentially actuate selected ones of the plurality of valves in a graded, non-abrupt manner such that at least a selected two of the valves are so gradedly actuated at all times to maintain a constant water flow rate through the water reservoir.

DESCRIPTION OF THE DRAWINGS

FIG. 1 illustrates a system comprising a water distribution apparatus for sequentially and gradedly controlling the flow of water to selected ones of hydraulically actuated cores for reciprocating motion of these cores into and out of a housing in response to the graded variation of fluid flow pressure.

FIG. 2 is a cross-section of a hydraulically actuated core within its housing, the core being in its retracted position within the housing as a result of the non-application of fluid pressure to the lower end of the housing.

FIG. 2A is a cross-section similar to that of FIG. 2 but with the core hydraulically actuated to be partially ejected outward from the housing as a result of the application of fluid pressure to the lower end of the housing.

FIG. 3 is an exploded assembly of the hydraulically actuated core and its housing as well as the weighting means coupled to the core for retraction of the core when fluid pressure is removed from the lower end of the housing.

FIG. 4 is a cross-sectional view along the lines 4—4 of FIG. 3 showing the emplacement of a jet outlet for the ejection of water from the core means when it is hydraulically actuated; the jet being off-set from the axis of rotation of the core so as to create a coupling moment.

DETAILS OF THE INVENTION

Figure 5:
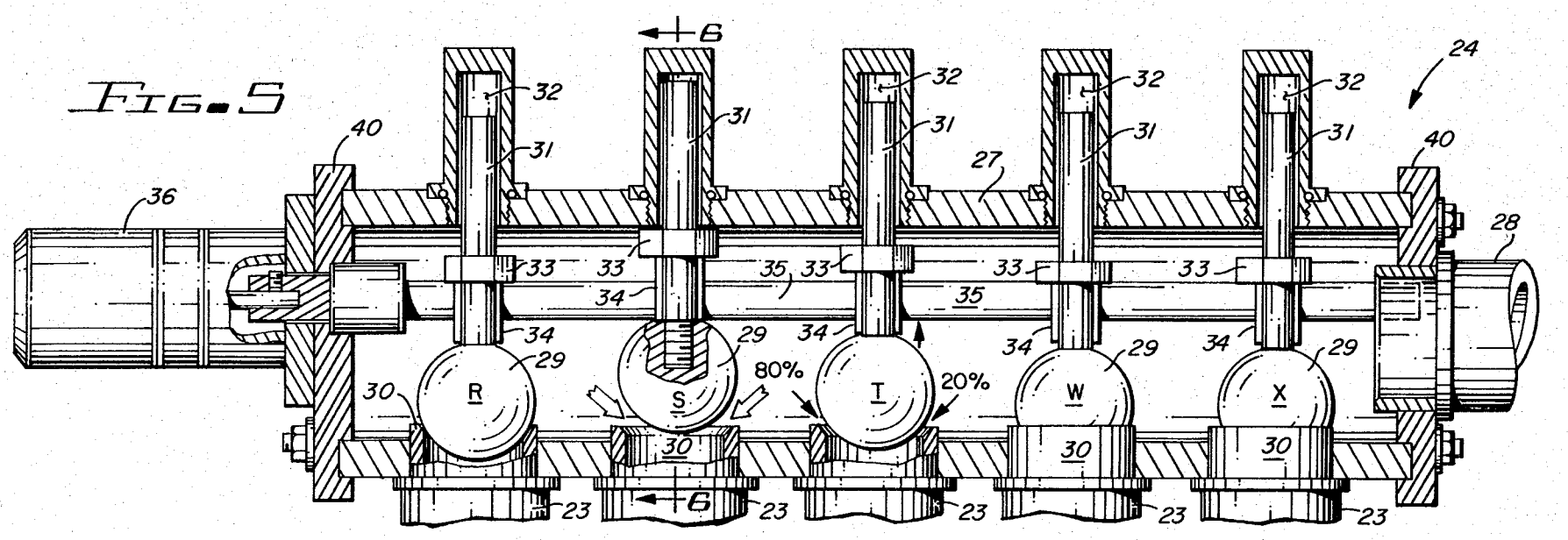
FIG. 5 is a cross-sectional drawing of the water distribution apparatus showing a plurality of ball valves being actuated by cams on a rotating cam shaft in a manner which provides sequential graded actuation of each ball valve in a manner which assures that water flow always passes through at least a selected two of these ball valves so that the total flow rate into and out of the water distribution apparatus is maintained constant.

For the purposes of promoting an understanding of the principles of the invention, reference will now be made to the embodiments illustrated in the drawings and specific language will be used to describe the same. It will, nevertheless, be understood that no limitation of the scope of the invention is thereby intended, such alterations and further modifications in the illustrated device, and such further applications of the principles of the invention as illustrated therein being contemplated as would normally occur to one skilled in the art to which the invention relates.

In FIG. 1 is illustrated a system wherein hydraulically actuated devices 10 are coupled to the outputs of the fluid distribution device 24 by means of fluid transmission means 23, for example, plastic piping. The fluid distribution assembly 24 accepts fluid from a source of pressurized fluid, for example, water, and outputs it to the fluid transmission lines 23 for communication of fluid from the distribution device 24 to individual ones of the hydraulically actuated pop-up cores of hydraulic devices 10. The fluid distribution device 24 provides for a graded application of fluid pressure in a sequentially selectable manner to each of the fluid transmission lines 23 and thus to each of devices 10 in a sequential manner. As will be more fully disclosed and as indicated by the two arrows indicative of fluid flow from distribution device 24, fluid will always flow from distribution device 24 into at least two of fluid transmission lines 23 such that the sum total of fluid flowing from all outputs of device 24 at all times equal the flow rate of fluid into device 24.

As suggested in FIG. 1, the hydraulically actuated device 10 may be embedded with its top surface essentially flush with the interior surface 25 of a swimming pool or other fluid container.

The hydraulically actuated devices 10 are disclosed in greater detail in the cross-sectional views of FIGS. 2 and 2A. Device 10 is seen to comprise a housing 11 of circular cross-section. Housing 11 is a one-piece structure. Housing 11 is provided with a first open end 12 and a second open end 13.

A first diameter-reducing shoulder 14 is provided at the open end 12 of housing 11. A second diameter-reducing shoulder 15 is emplaced at a selected position between the first open end 12 and the second open end 13 of housing 11.

Diametrically opposed notches 16, hereinafter referred to as egress means 16, are emplaced in shoulder 14. Egress means 16 are best seen in the illustration of housing 11 in FIG. 3. A weighting means 17, here depicted as an annulus, is emplaced within the open end 12 of housing 11 and positioned to rest with its central axis of rotation parallel to the central axis of rotation of cylinder 11.

A hydraulically actuated cylindrical core 18 is emplaced through open end 12 into the housing 11 and is coupled to weight 17 by means of, for example, screw fasteners 21 as referenced in FIG. 3.

Fluid transmission means, or piping, 23 is coupled to the open end 13 of housing 11. An adhesive may be employed, in conventional manner, to affix fluid transmission means 23 to housing 11.

In the assembled cross-section of hydraulically actuated device 10 in FIG. 2, the cylinder 18 is illustrated with its top essentially flush with the first open end 12 of housing 11. This condition occurs when cylinder 18, coupled to weight 17, is in its retracted position, with weight 17 resting on shoulder 15 in the absence of fluid pressure in fluid transmission means 23. When a flow of water or other fluid, as indicated by the arrows in FIG. 2A, is introduced into the transmission means 23, the hydraulic pressure applied to cylinder 18 as a result causes cylinder 18 to rise and be partially ejected from housing 11. Total ejection is prevented by the interfering relationship between weight 17 and shoulder 14 of housing 11.

The assembly of hydraulic device 10 is illustrated in the exploded perspective assembly drawing of FIG. 3. The annular weight 17 is inserted so as to pass through egress means 16 into housing 11. Weight 17 may thereafter be rotated within housing 11 to lie on shoulder 15 as illustrated in the cross-section of FIG. 2. Cylinder 18 is then inserted into the open end 12 of housing 11 and screw fasteners 21 are passed through counter-bored openings 27 for engagement with threaded openings 22 in weight 17. The resultant assembly is that depicted in FIG. 2.

Weight 17 provides the necessary mass to return cylinder 18 from its ejected position, FIG. 2A, to its retracted position, FIG. 2, as a result of gravity acting on the mass of weight 17.

A jet outlet 26 may be provided in cylinder 18 to communicate with the pressurized water communicated to housing 11 for actuation of cylinder 18. By supporting jet orifice 26 such that its axis A, FIG. 4, is displaced from the axis of rotation C of cylinder 18, a coupling moment is created when a jet of water is emitted from jet orifice 26 causing the rotation of cylinder 18 about its axis C.

Figure 12:
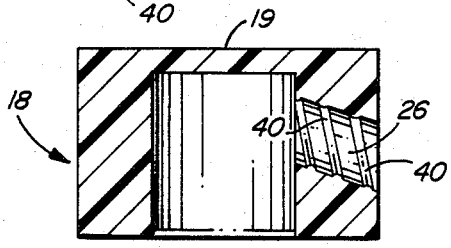
FIG. 12 is a cross-sectional view of the hydraulically actuated core illustrating the manner in which the water jet outlet is directed downwardly to achieve greater dispersion of matter in the close proximity to the pop-up head and to provide additional sealing force between the weight coupled to the core and the retaining shoulder within the housing.

When hydraulic devices 10 are embedded in the interior surfaces 25 of swimming pool, as suggested in FIG. 1, the communication of a pressurized fluid via fluid transmission means 23 to housing 11 causes cylinder 18 to be partially ejected from housing 11, as depicted in FIG. 2A, and a jet of water to be emitted from jet orifices 26 to agitate the water in the immediate vicinity of hydraulically actuated device 10 so as to raise matter, which has settled into the pool, from the interior surface of the pool and to place such matter in suspension so that it may be more easily and readily drawn by the water circulation system of the pool to the filter associated with such pool. In prior art devices of a similar nature, the pressurized stream of water emitted by the jet orifice 26 is directed in an adjacent parallel relationship to the inner surface of the pool. It has been found that a significant improvement in the scrubbing action of the emitted jet stream with respect to the interior surface of the swimming pool results by departing from the prior art's prescription of emitting the jet stream of water in a parallel relationship to the inner surface of the pool. By directing jet orifice 26 in a downward direction, as depicted in FIG. 12, the accelerated stream of water interacts with settled matter lying closer on the interior surface of the pool to hydraulically actuated device 10. Thus, settled matter in close proximity to device 10 is stirred up and put into suspension in the water of the pool. Further, the action of the downward accelerated stream of water emitted by jet 26 tends to further raise cylinder 18 to bring weight 17 into more intimate bearing relationship with shoulder 14 so as to prevent the leakage of water around the intersection of weight 17 and shoulder 14.

A significant problem is associated with prior art devices using pop-up water distributors similar to hydraulically actuated device 10. This problem arises from the fact that water pressure has been applied to the pop-up head in essentially step-functional change of pressure from zero pressure to maximum pressure. Such a step functional pressure shock causes the pop-up head of prior art devices to be abruptly actuated to slam outwardly from its housing and to be brought to an abrupt and shocking stop at the limit of its travel. Thus, the pop-up head assemblies of prior art devices have experienced limited useful lives and, in many instances, have required expensive repairs to be made with respect to the cleaning system of the swimming pools in which they are used.

An additional problem occuring with the step functional application and withdrawal of water pressure is the water hammer, pressure surge experienced by the entire pool cleaning system which can lead to failures of the plumbing lines, water pump, and filter mechanisms.

In the system disclosed herein, pressure is applied in a graded manner to the hydraulically actuated device 10 such that cylinder 18 moves reciprocally within housing 11 in a graded, non-abrupt manner. The word "graded" is here used to indicate a gradual increase or decrease of fluid pressure or fluid flow or a gradual increase or decrease of movement of elements with respect to the step-functional increase of pressure or movement normally associated with prior art systems.

To further insure that water hammer, pressure surges are obviated from the system being here disclosed, means are provided for maintaining the circulating flow of pressurized fluid at a constant flow rate regardless of which of the hydraulically actuated devices 10 are being actuated.

The fluid distribution device 24 provides for the graded control of pressure and fluid flow to the system. The graded fluid distributor 24 is comprised of a water vessel, or reservoir, 27 having an inlet 28 which is connected to a source of pressurized water or other fluid, not shown. A plurality of ball valves 29 are housed within reservoir 27. A plurality of fluid outputs 30, one of each associated with one of each of ball valves 29, provide for the output of fluid from reservoir 27. Outputs 30 also act at the valve seat for ball valves 29. A guide rod 31 is coupled to each ball valve 29 to be exercised within guideways 32.

Valve lifters 33 are provided on guide rods 31 to permit the graded actuation of ball valves 29 by cams 34 emplaced along cam shaft 35. A drive motor 36 drives cam shaft 35 to sequentially bring cams 34 into contact with sequentially selected valve lifters 33 of ball valves 29.

FIG. 5 illustrates ball valves 29 particularly designated by the letters R, S, T, W, and X. The arrows flowing to the outlets 30 about ball valve S and ball valve T are indicative of the relative fluid flow passing out of valves S and T. The broader arrows at valve S, labeled 80%, indicate that 80% of the fluid flowing through input 28 into reservoir 27 is exiting the output 30 of ball valve S. The smaller arrows directed to the output of ball valve T and labeled 20% indicate that 20% of the input fluid flow to reservoir 27 is exiting via the output 30 of ball valve T. By way of example, it is presumed that ball valve S has been raised by its cam 34 to its maximum displacement from its valve seat 30 and at this point, for illustrative purposes, 80% of the input fluid flow exits through ball valve S. Again, by way of example, it is presumed that when ball valve S has been drawn up to its maximum excursion point, ball valve T will have been drawn upward by its associated cam 34 to the extent that 20% of the input fluid flow exits through ball valve T.

Figure 7B:
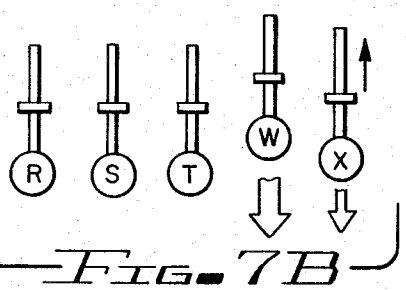
FIGS. 7A–7D illustrate the sequential, graded actuation of the ball valves of the water distribution assembly such that a sequentially selected two of these ball valves is always gradedly actuated to provide a constant through-put flow rate of fluid through the distribution assembly.
Figure 7A:
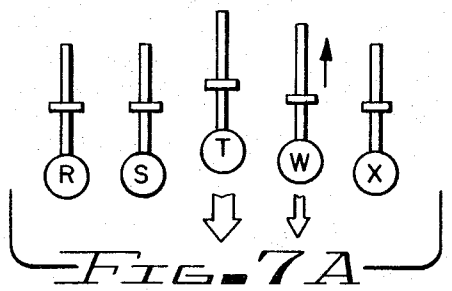
Figure 7D:
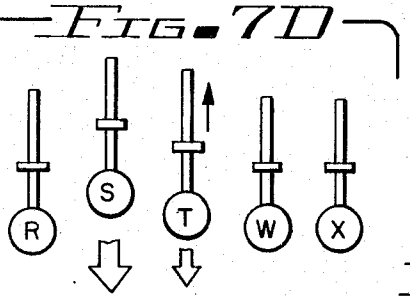
Figure 7C:
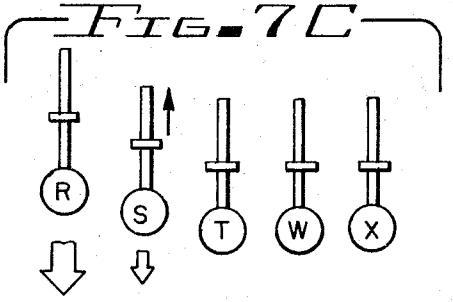

The fact that two of the plurality of ball valves 29 are illustrated as being in an opened position such that one hundred per cent of the input fluid flow exits reservoir 27 is intentional since by maintaining an output flow rate equivalent to the input flow rate, no water hammer, pressure surges can result in the system. The operation of cam shaft 35 is to sequentially raise ball valves 29 from their valve seats 30. The raising of these valves from their valve seats is a graded, non-abrupt movement. The sequential operation of the valves is depicted in the series of illustrations 7A–7D. Referring momentarily to the position of ball valves 29 in FIG. 5, it is seen that valve S is at the top of its excursion and that valve T has been partially exercised to permit 20% of the input fluid flow to exit thereby. In FIG. 7A, ball valve T has been exercised to its topmost excursion such that 80% of the input fluid flow passes thereby; valve W has been partially raised to permit 20% of the input flow to pass thereby; and valve S has once again been seated in its valve seat. This sequence is repeated throughout the illustration. In 7B, valve W passes 80% of the input flow while X passes 20% and valve T has closed. In FIG. 7C, valve R has been exercised to pass 80% of the fluid flow and valve S has been exercised to the point where it passes 20%. In FIG. 7D, valve R has been permitted to close and valve S exercised to its maximum excursion to pass 80% of the fluid flow and valve T partially exercised to permit 20% of the flow. This operational sequence then returns to that of FIG. 5 and continues as illustrated again in FIGS. 7A through 7D.

It is thus seen that the operation of water distribution system provides graded pressure control to the output of fluid to transmission lines 23 coupled to the outputs 30 of reservoir 27. Each of transmission lines 23 is sequentially and gradedly charged by the fluid flowing into and out of reservoir 27. The hydraulically actuated devices 10, as illustrated in FIG. 1, are thus themselves sequentially and gradedly actuated so that the exercise of cylinder 18 within housing 11 is a graded actuation moving the cylinder 18 outward and back into housing 11 in a graded, non-abrupt manner.

Such graded actuation of cylinder 18 into and out of housing 11 has the added advantage in that jet orifice 16 does not abruptly obtrude above opening 12 of housing 11 but rather is raised in a gradual and graded manner permitting a jetted stream of water to be ejected into the surrounding pool interior while cylinder 18 is still rotating in the course of its excursion into and out of housing 11. Thus, the stream of water injected into the pool from jet orifice 16 is not done so abruptly and in a fixed direction but is done relatively gradually while the jet orifice is still rotating with cylinder 18 during the excursion of cylinder 18 into and out of housing 11. Such action provides a further improvement over the action of prior art, abruptly exercised pop-up heads.

Graded water distributor 24 is such that no tight tolerances are employed anywhere in the system. This is an important feature since sand or other small matter may pass through the filter and into fluid distributor 24. Guide rods 31 need not be precisely aligned within guideways 32 to provide proper operation of ball valves 29. Neither is it required that there be a precision of contact in the relationship between cams 34 and valve lifters 33. The ball valves 29 are generally self-seating and self-cleaning devices.

Figure 6:
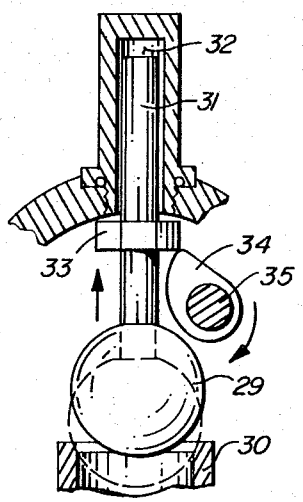
FIG. 6 is a cross-sectional detail of a ball valve showing the manner in which it is cam actuated to its full-open position and its return to its full-closed position under the influence of gravity as the contact between the cam and the cam lifter is gradually removed.

Reference is now made to the cross-section of FIG. 6 taken along line 6—6 of FIG. 5. Ball valve 29 is illustrated in phantom outline seated in valve seat 30. As cam shaft 35 rotates, cam 34 is brought into contact with valve lifter 33, lifting ball valve 29 from valve seat 30 and moving guide rod 31 upwards into guideway 32. Cam 34 has a curved surface so that when ball valve 29 is drawn to the topmost point of its excursion, contact between valve lifter 33 and cam 34 is withdrawn in a gradual, graded manner as cam shaft 35 continues its rotation. Thus, ball valve 29 is gradedly raised from valve seat 30 and similarly, gradedly lowered back into contact therewith.

Figure 8:
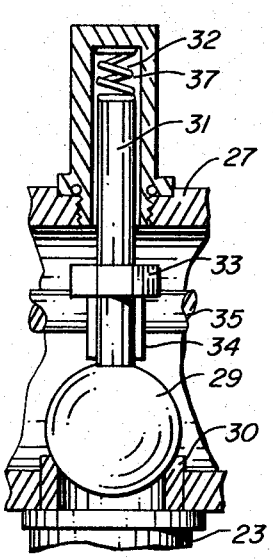
FIG. 8 is a cross-section similar to that of FIG. 6 but illustrates the use of an optional valve spring which permits orientation of the water distribution system in a manner which is non-dependent upon the gravity return of the ball valves to their fully-closed position.

In the illustration of FIG. 6, the effect of gravity upon ball valve 29 is utilized to return ball valve 29 to its valve seat 30. This requires, then, that guide rods 31 be oriented in an essentially vertical plane with the ball valve 29 at the lower end of guide rod 31. Should it be desired for any reason that water distributor 24 be operated in any other orientation, an optional valve spring 37, illustrated in FIG. 8, may be provided to return ball valve 29 to its seat 30 after being exercised by a cam 34.

In the cross-sectional illustration of the graded water distribtor device 24 of FIG. 5, an electric drive motor was employed to drive cam shaft 35.

Figure 9:
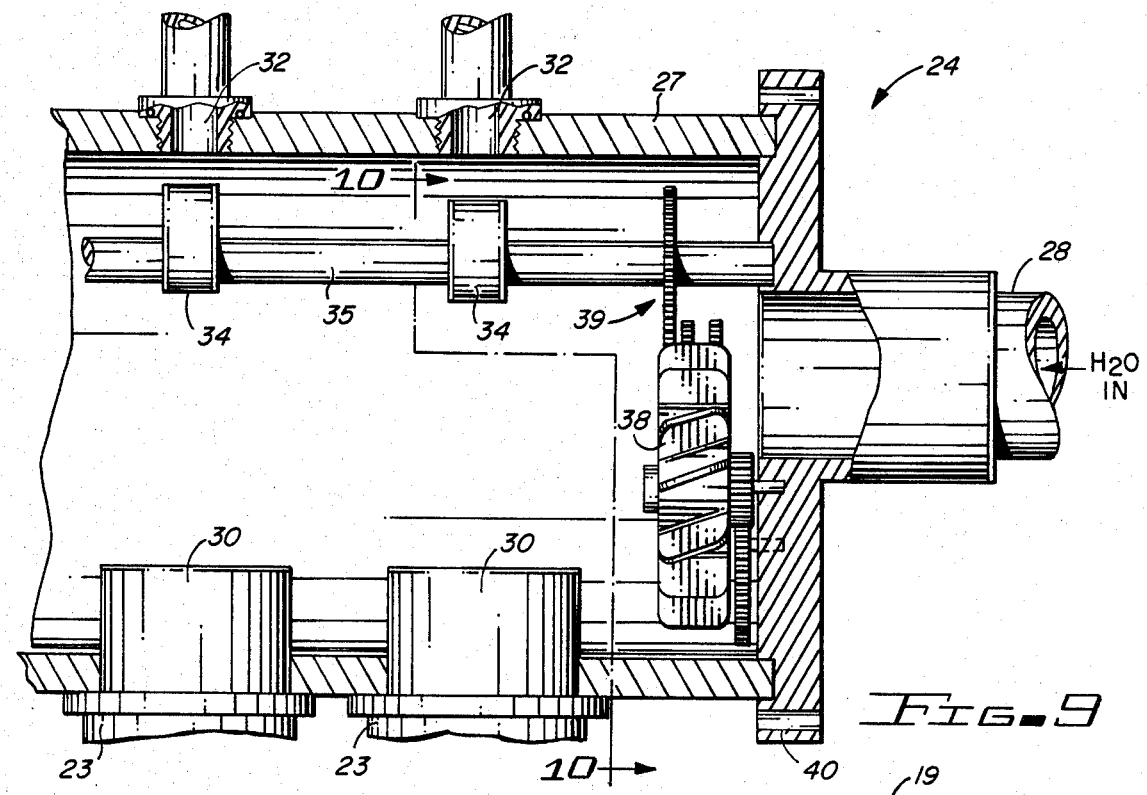
FIG. 9 illustrates in cross-section the use of a water driven turbine and gear train assembly for driving the cam shaft of the water distribution assembly.
Figure 10:
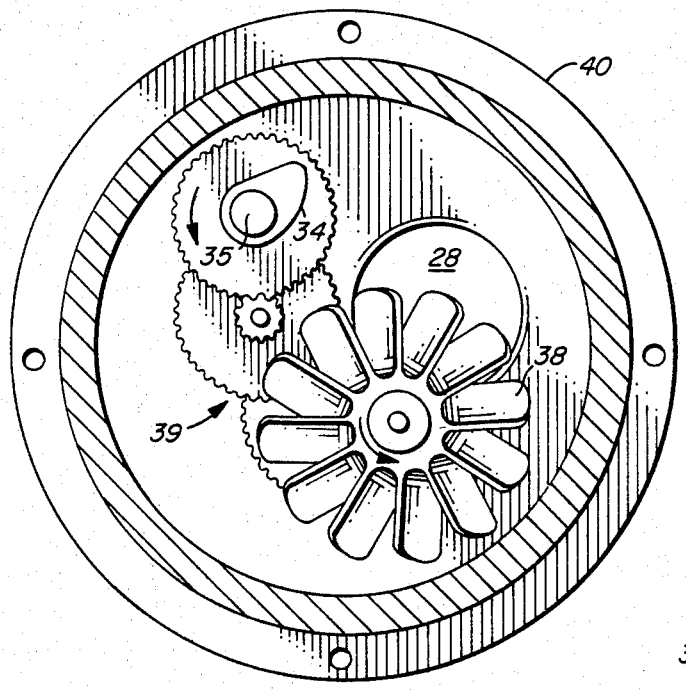
FIGS. 10 and 11 show additional details of the water driven turbine and the gearing assembly for driving the cam shaft.
Figure 11:
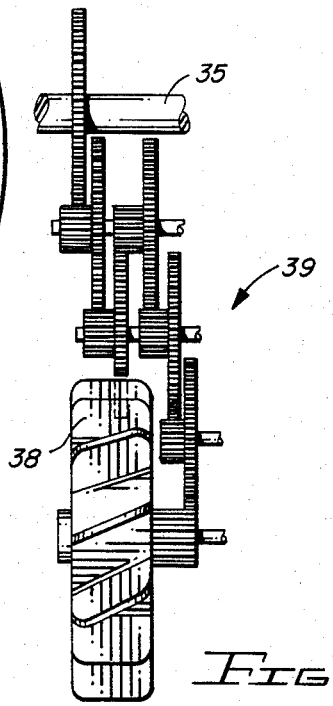

In FIG. 9, a simplified cross-sectional view of graded water distributor 24, a water turbine wheel 38 and associated gear train 39 is employed for driving cam shaft 35. The water turbine wheel 38 is rotated adjacent to the input 28 to water reservoir 27. The entering water causes turbine wheel 38 to rotate and this rotation is communicated by gear train 39 to cam shaft 35. Additional details are shown in FIGS. 10 and 11. The conceptual details of such turbine drives are well known to those skilled in the art.

Turning again to FIG. 12, it is noted that the jet orifice 26 is provided with rifle lands 41. The action on the jet of water exiting jet orifice 26 is similar to that experienced by a bullet exiting a rifle. Riffle land 41 imparts a spin to the water jet which obviates the tendency for formation of laminar flow of the jet in the pool water which can occur with a non-spinning jet. The spinning water jet has a greater agitation effect on the surrounding water and on the settled matter on the interior surface of the pool. Thus, the settled matter is moved more readily into suspension in the pool water to be carried thereby to the filtering system of the pool.

What has been described is a hydraulically actuated device which may be employed as part of a pool cleaning system. An improved structural assembly of a hydraulically actuated core within an assembly provides ease of manufacture and assembly. Graded control of the application of pressure and the flow of fluid through the system is provided so that the hydraulic device is actuated in a relatively gradual and graded manner to overcome the deleterious effects of abrupt actuation of such devices and the resultant water hammer, pressure surges which are generated in such abruptly operated systems. Improved jet means enclosed within the hydraulically actuated cylinder of the device provides for more efficient disturbance of sediments on the interior surfaces of the pool both in the immediate vicinities of the hydraulically actuated devices and at distances further removed therefrom. Means for gradedly controlling fluid flow and sequentially actuating selected hydraulically controlled devices are provided in a manner which ensures that a constant rate of fluid flow through the system is maintained at all times.

Those skilled in the art will recognize that other embodiments of the invention may be drawn from the illustrations and the teachings herein. To the extent that such alternate embodiments are so drawn, it is intended that they shall fall within the ambit of protection of the claims appended hereto.

Having disclosed our invention in the foregoing specification and accompanying drawings in such clear and concise manner that those skilled in the art will readily understand and easily practice the invention, that which we claim is:

1. Hydraulically actuated core means captively ejectable from its housing upon application of hydraulic force comprising:

cylindrical housing means having first and second open ends, first diameter-reducing shoulder means adjacent said first open end, second diameter-reducing shoulder means at a selected position between said first and second open ends, diametrically opposed egress means interrupting said first diameter-reducing internal shoulder means;

annular weighting means insertable within said cylindrical housing means via said egress means and positionable thereafter within said housing means with its transverse axis orthogonal to the longitudinal axis of said housing means and reciprocal therein within limits defined by said first and said second diameter-reducing shoulder means;

cylindrical core means insertable within said first open end of said cylindrical housing means and reciprocal therein and having a top end and a bottom end said top end lying at a selected position with respect to said first open end of said housing means when said bottom end is in contact with said annular weighting means and said annular weighting means is in contact with said second diameter-reducing shoulder; and means for coupling said cylindrical core means to said annular weighting means after both have been positioned within said cylindrical housing.

2. The hydraulically actuated core means of claim 1 further comprising transmission means for communicating fluid under pressure to said second open end of said housing means.

3. The hydraulically actuated core means of claim 2 further comprising:

a source of fluid under pressure; and means coupled between said transmission means and said source of fluid for gradedly governing said fluid pressure between selected maximum and minimum limits for non-abruptly exercising said cylindrical core means within limits established by said first and second diameter-reducing shoulder means.

4. The hydraulically actuated core means of claim 3 further comprising:

a plurality of said hydraulically actuated core means;

a plurality of transmission means, one of each coupled to one of each of said plurality of said hydraulically actuated core means for communicating fluid under pressure to said second open end of each of said cylindrical housing means of said plurality of said hydraulically actuated core means; and said means for gradedly governing said fluid pressure further comprising means for sequentially, gradedly governing fluid pressure to each of said plurality of transmission means for sequentially, non-abruptly exercising selected ones of said cylindrical core means of selected ones of said plurality of said hydraulically actuated core means.

5. The hydraulically actuated core means of claim 4 wherein each of said cylindrical core means of said plurality of said hydraulically actuated core means further comprises jet means for ejecting pressurized fluid from said source of fluid under pressure when said selected ones of said cylindrical core means are exercised to protrude beyond said first open end of their said cylindrical housing means.

6. The hydraulically actuated core means of claim 5 wherein each said cylindrical core means comprises means for supporting said jet means off-set from the longitudinal axis of rotation such that a coupling moment is created to rotate each said cylindrical core means as each said cylindrical core means is exercised between the limits set by said first and second diameter-reducing shoulders within its cylindrical housing means.

7. The hydraulically actuated core means of claim 6 further comprising a fluid container having a bottom in which said plurality of hydraulically actuated core means are embedded with said first open end of each of said cylindrical housing means of each of said plurality of hydraulically actuated core means flush with said bottom of said fluid container.

8. The hydraulically actuated core means of claim 7 wherein said fluid container is a swimming pool and said jet means is directed downwardly toward the bottom surface of said pool.

9. The hydraulically actuated core means of claim 8 wherein said plurality of fluid transmission means is embedded beneath the bottom of said swimming pool.

10. The hydraulically actuated core means of claim 6 wherein said means for sequentially, gradedly governing said fluid pressure and non-abruptly exercising selected ones of said cylindrical core means comprises a plurality of sequentially actuated fluid valve means each communicating with one of said plurality of said transmission means and each said valve means further comprising means for gradedly controlling the flow of pressurized fluid sequentially through each said valve means to gradedly exercise sequentially selected ones of said cylindrical core means.

11. The hydraulically actuated core means of claim 10 wherein said means for gradedly controlling the flow of pressurized fluid sequentially through each said valve means further comprises means for maintaining a constant flow rate of fluid into and out of said means for sequentially, gradedly governing said fluid pressure and non-abruptly exercising selected ones of said cylindrical core means.

12. The hydraulically actuated core means of claim 11 wherein said means for maintaining a constant flow rate of fluid further comprises means, coupled to said means for gradedly controlling flow of pressurized fluid sequentially through each said valve means, for maintaining fluid flow through at least a selected two of said plurality of fluid valve means as said plurality of fluid valve means are sequentially actuated such that a constant flow rate of fluid is maintained into and out of said means for sequentially, gradedly governing said fluid pressure and non-abruptly exercising said selected ones of said cylindrical core means.

13. The hydraulically actuated core means of claim 12 wherein said means for maintaining fluid flow through at least a selected two of said plurality of fluid valve means comprise a plurality of cam valve actuating means coupled to a cam shaft said cams being emplaced on said cam shaft for selectable, sequential, graded actuation of said fluid valve means such that at least two of said plurality fluid valve means will always be selectedly gradedly actuated to communicate fluid to selected ones of said plurality of transmission means.

14. The hydraulically actuated core means of claim 6 wherein said jet means comprises a rifled jet orifice.

15. The hydraulically actuated core means of claim 8 wherein said jet means comprises a rifled jet orifice.

16. The hydraulically actuated core means of claim 13 wherein said jet means comprises a rifled jet orifice.

* * * * *